US012560414B1

(12) United States Patent
West

(10) Patent No.: US 12,560,414 B1
(45) Date of Patent: Feb. 24, 2026

(54) IMPACT DISTANCE SCORING SYSTEM FOR CLAY TARGET SHOOTING

(71) Applicant: Andrew West, Alvord, TX (US)

(72) Inventor: Andrew West, Alvord, TX (US)

( * ) Notice: Subject to any disclaimer, the term of this patent is extended or adjusted under 35 U.S.C. 154(b) by 7 days.

(21) Appl. No.: 18/664,022

(22) Filed: May 14, 2024

Related U.S. Application Data

(60) Provisional application No. 63/595,583, filed on Nov. 2, 2023.

(51) Int. Cl.
*F41J 5/14* (2006.01)
*F41J 2/00* (2006.01)

(52) U.S. Cl.
CPC .. *F41J 5/14* (2013.01); *F41J 2/00* (2013.01)

(58) Field of Classification Search
None
See application file for complete search history.

(56) References Cited

U.S. PATENT DOCUMENTS 9,605,926 B1 * 3/2017 Means ..... G01S 19/14
9,816,783 B1 * 11/2017 Means ..... G01S 19/53
10,302,397 B1 * 5/2019 Means ..... F41J 5/14
10,648,781 B1 * 5/2020 Behiel ..... F41A 33/00
10,746,512 B2 * 8/2020 Howe ..... F41J 9/00
2009/0295624 A1 * 12/2009 Tuxen ..... G01S 13/72 342/147
2011/0311949 A1 * 12/2011 Preston ..... F41G 3/2655 434/16
2014/0100037 A1 * 4/2014 Condon ..... A63H 17/00 463/40
2016/0018198 A1 * 1/2016 Pettey ..... F41J 9/02 273/406
2016/0300506 A1 * 10/2016 Reichow ..... G09B 19/0038
2017/0169721 A1 * 6/2017 Schaller ..... F41J 9/165
2018/0003816 A1 * 1/2018 Olson ..... G01S 13/91
2019/0186876 A1 * 6/2019 Howe ..... G01S 13/867
2020/0018571 A1 * 1/2020 Kang ..... F41A 33/02
2021/0156652 A1 * 5/2021 Løkka ..... F41J 9/18
2024/0167796 A1 * 5/2024 Callender ..... F41J 11/00
2024/0288248 A1 * 8/2024 Ziliani ..... F41J 5/12

* cited by examiner

*Primary Examiner* — Seng H Lim
(74) *Attorney, Agent, or Firm* — Richard Eldredge; Leavitt Eldredge Law Firm

(57) ABSTRACT

An impact distance scoring system for clay target shooting includes a target embedded with a tracking sensor, a launching mechanism, a plurality of detection units, and a processing unit. The system is designed to determine the distance after launch at which a clay pigeon is struck by a shooter's projectiles, offering a quantifiable method for scoring in clay target shooting sports. The plurality of detection units is dispersed within a field of play at regular intervals. As the target travels across the field of play, the tracking sensor is detected by the detection units. The processing unit receives signals from the detection units to ascertain the travel distance of the target and calculates a score based on this distance. A display device connected to the processing unit provides a visual output of the score and travel distance, facilitating immediate feedback to the shooter.

3 Claims, 3 Drawing Sheets

IMPACT DISTANCE SCORING SYSTEM FOR CLAY TARGET SHOOTING

CROSS-REFERENCE TO RELATED APPLICATIONS

This application claims the benefit of U.S. Provisional Application No. 63/595,583, filed on Nov. 2, 2023, which is hereby incorporated by reference in its entirety.

BACKGROUND

1. Field of the Invention

The present invention relates generally to target shooting systems, and more specifically to a system for scoring and distance measurement in clay pigeon shooting.

2. Description of Related Art

Target shooting systems are well known in the art. Skeet and trap shooting are variants of a popular form of target shooting involving clay targets being launched into the air for a participant to attempt to shoot, typically using a shotgun.

One of the problems commonly associated with conventional clay target shooting systems is the inability to quantitatively measure the distance at which a clay pigeon is struck by a shotgun blast. In existing clay target shooting systems, subjective visual confirmation is used to determine if and when a pigeon is hit. However, the occurrence of a hit is the sole determined result, and no technology currently exists to measure the distance traveled into the field of play before the hit occurs. Having this distance information would provide an additional dimension for competition and training purposes.

Accordingly, although great strides have been made in the area of target shooting systems, many shortcomings remain. It is therefore an object of the present invention to provide a system that determines the distance a clay pigeon has traveled when struck, thereby enabling objective scoring based on measurable criteria.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
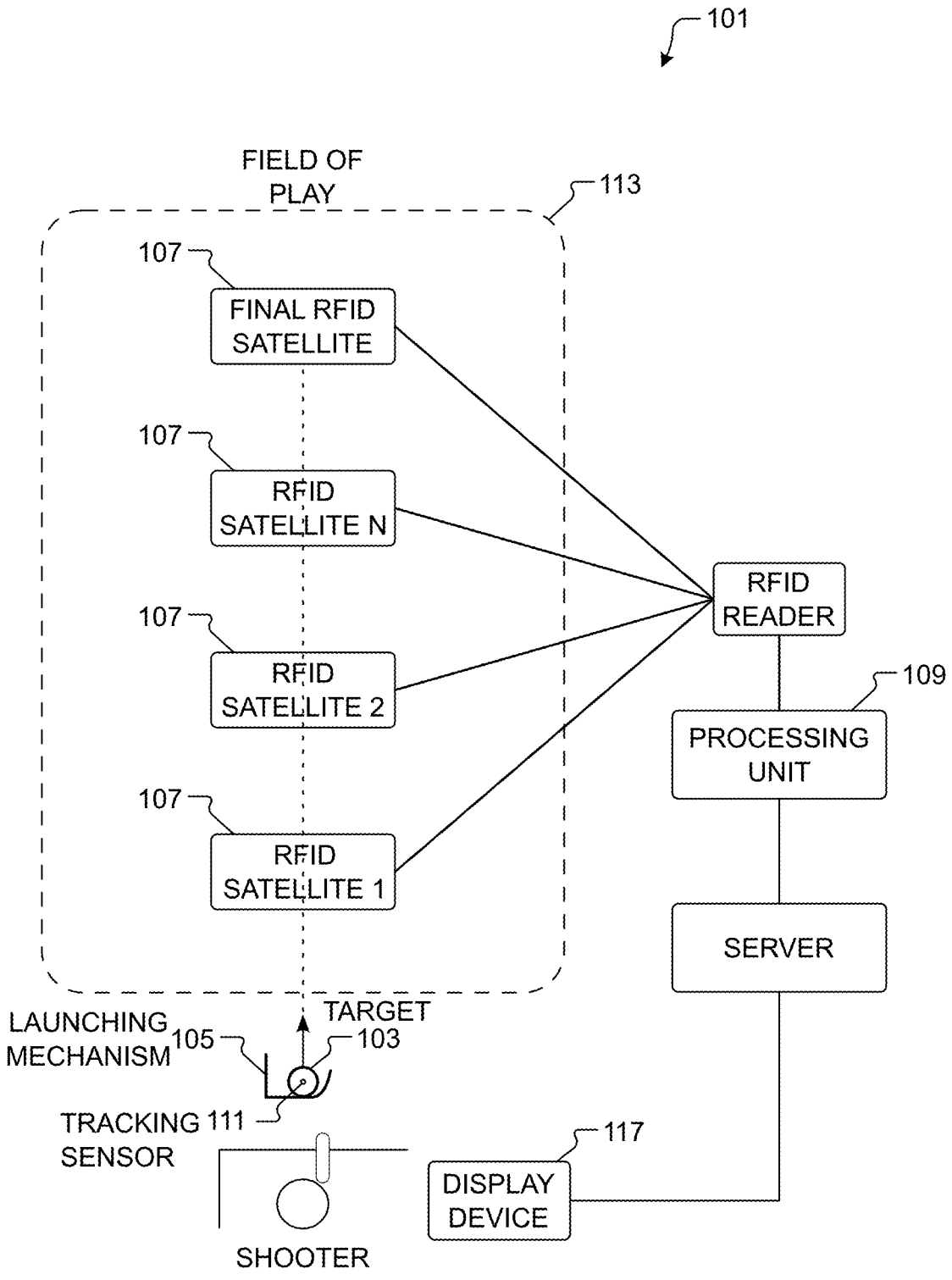
FIG. 1 is a diagrammatic illustration of a preferred embodiment of the impact distance scoring system of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional clay target shooting scoring methods. Specifically, the system of the present invention provides a means to quantify the distance after launch at which a clay pigeon is struck by a target shooter. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
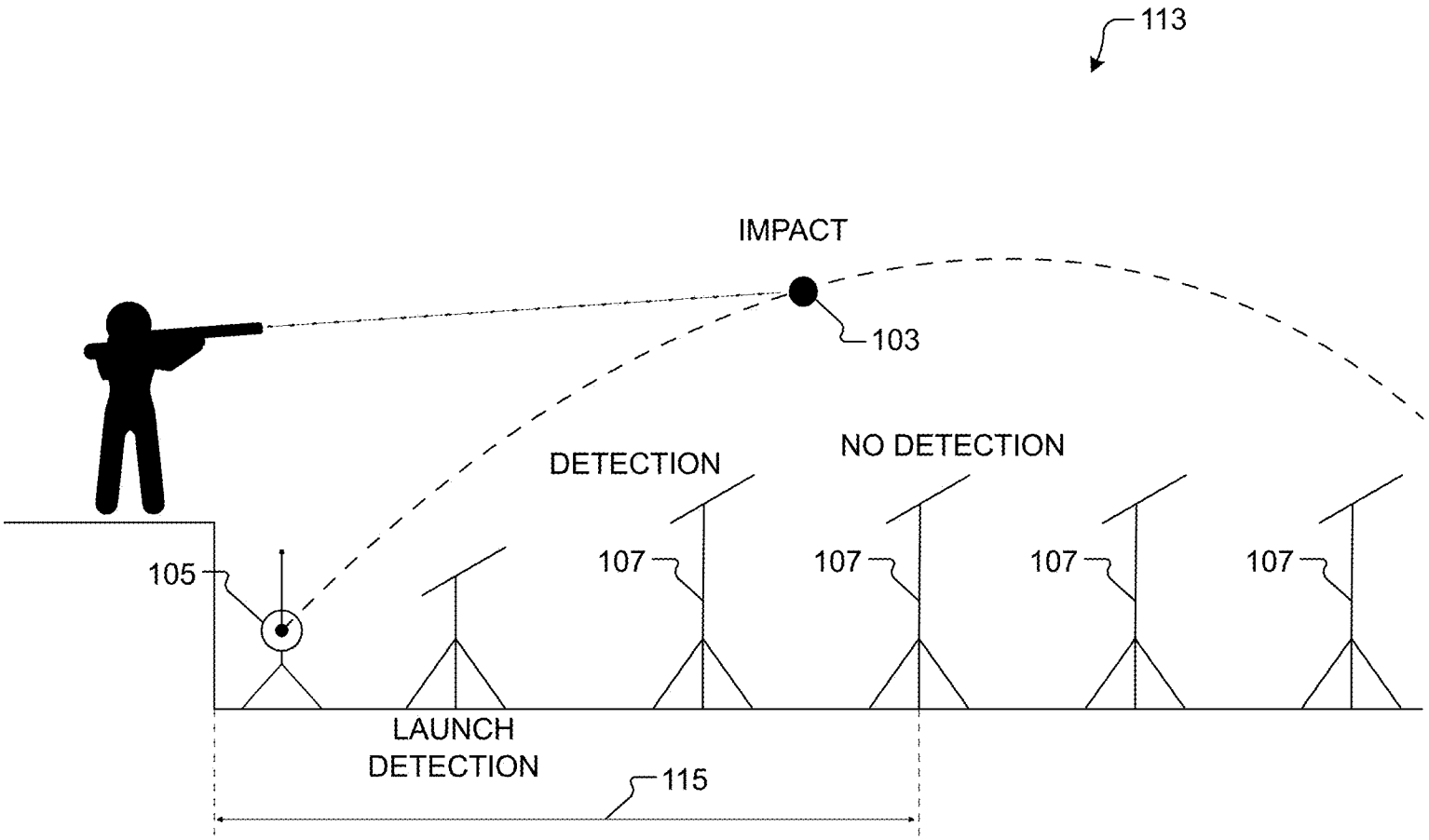
FIG. 2 is a side illustration of the use of the impact distance scoring system.

Referring now to the drawings wherein like reference characters identify corresponding or similar elements throughout the several views, FIGS. 1-2 depict illustrative views of an impact distance scoring system 101 in accordance with a preferred embodiment of the present application. It will be appreciated that the impact distance scoring system 101 overcomes one or more of the above-listed problems commonly associated with conventional clay target shooting scoring methods. In addition, it should be appreciated that more or fewer of such components may be included in different embodiments of the impact distance scoring system 101.

The present invention is primarily intended for use in skeet and trap shooting, though it is contemplated that the present invention may be adapted for use in various other suitable applications without departing from the spirit and scope herein disclosed. In the contemplated embodiment, the impact distance scoring system 101 includes a target 103, a launching mechanism 105, a plurality of detection units 107, and a processing unit 109. The target 103 may be a typical clay pigeon or any other suitable target 103 in different embodiments, and has an embedded or otherwise affixed tracking sensor 111. In some embodiments, the tracking sensor 111 may be externally adhered to any conventional clay pigeon. The launching mechanism 105, such as a clay pigeon thrower, is configured to propel the target 103 into a field of play 113, presenting the user with a ballistic target as in typical skeet and trap systems.

The plurality of detection units 107 is distributed according to a specified pattern within the field of play 113. In different embodiments the specified pattern may vary. For example, the specified pattern may comprise a single-file line beginning at the shooter's bay and extending at predetermined intervals—for example, every ten yards—into the field of play 113 parallel to the ballistic trajectory of the target 103, or the specified pattern may comprise a grid consisting of multiple rows and columns, or any other desired arrangement.

The processing unit 109 is in communication with the plurality of detection units 107. The processing unit 109 may be understood to correspond to any electronic component or collection of components that enables the data collection and processing functionalities necessary to carry out the overall functionality of the present invention. For example, in some embodiments the processing unit 109 may be a microcontroller, while in others the processing unit 109 may be a desktop computer, a server, a cloud computing network, a combination thereof, or other applicable configurations.

Each detection unit 107 is configured to detect the tracking sensor 111 as the target 103 passes overhead along its ballistic trajectory. The processing unit 109 is configured to receive detection signals from the detection units 107 and process the detection signals to determine a travel distance 115 of the target 103.

In the contemplated embodiment, the tracking sensor 111 embedded within the target 103 is a radio frequency identification (RFID) tag, while the detection units 107 are RFID readers capable of detecting a signal emitted by the RFID tag. It is contemplated, however, that alternative sensing means may be employed in various embodiments, and the impact distance scoring system 101 of the present invention should not be limited solely to the use of RFID systems.

More particularly, the tracking sensor 111 is a passive RFID tag that receives an interrogation signal emitted by a detection unit upon entering range of the unit. Receiving the interrogation signal induces an electrical current in the passive RFID tag, energizing the RFID tag and causing a response signal to be emitted by the RFID tag, which in turn is captured by the RFID reader, relayed to the processing unit 109, and interpreted as a detection event. More particularly, in some embodiments, each detection unit may be understood to be an RFID satellite, each RFID satellite being in communication with a main RFID reader acting as a hub for the RFID satellites, the main RFID reader being in communication with the processing unit 109.

It is also contemplated and will be appreciated that the processing unit 109 can incorporate a scoring algorithm to calculate scores based on the determined travel distance 115, providing a quantifiable measure of shooting accuracy. More particularly, as the target 103 travels along its ballistic path it will be detected by multiple detection units 107 in succession until it is no longer detected, which is assumed to correspond with the shooter making a successful shot, destroying the target 103. The location of the last detection unit at which the target 103 is detected is used to determine a score that is assigned to the shooter. If the target 103 is detected by all detection units 107 along the ballistic trajectory of the target 103 including a final detection unit, it is assumed that the shooter missed their shot and is consequently awarded no points or some other corresponding scoring protocol, such as deducting points in some embodiments.

It is also contemplated and will be appreciated that the impact distance scoring system 101 can incorporate a display device 117 in communication with the processing unit 109. The display device 117 is configured to display the determined travel distance 115 and/or the calculated score determined by the scoring algorithm. Preferably, the display device 117 is located within the shooter's bay, allowing for immediate feedback regarding the shooter's performance.

Figure 3:
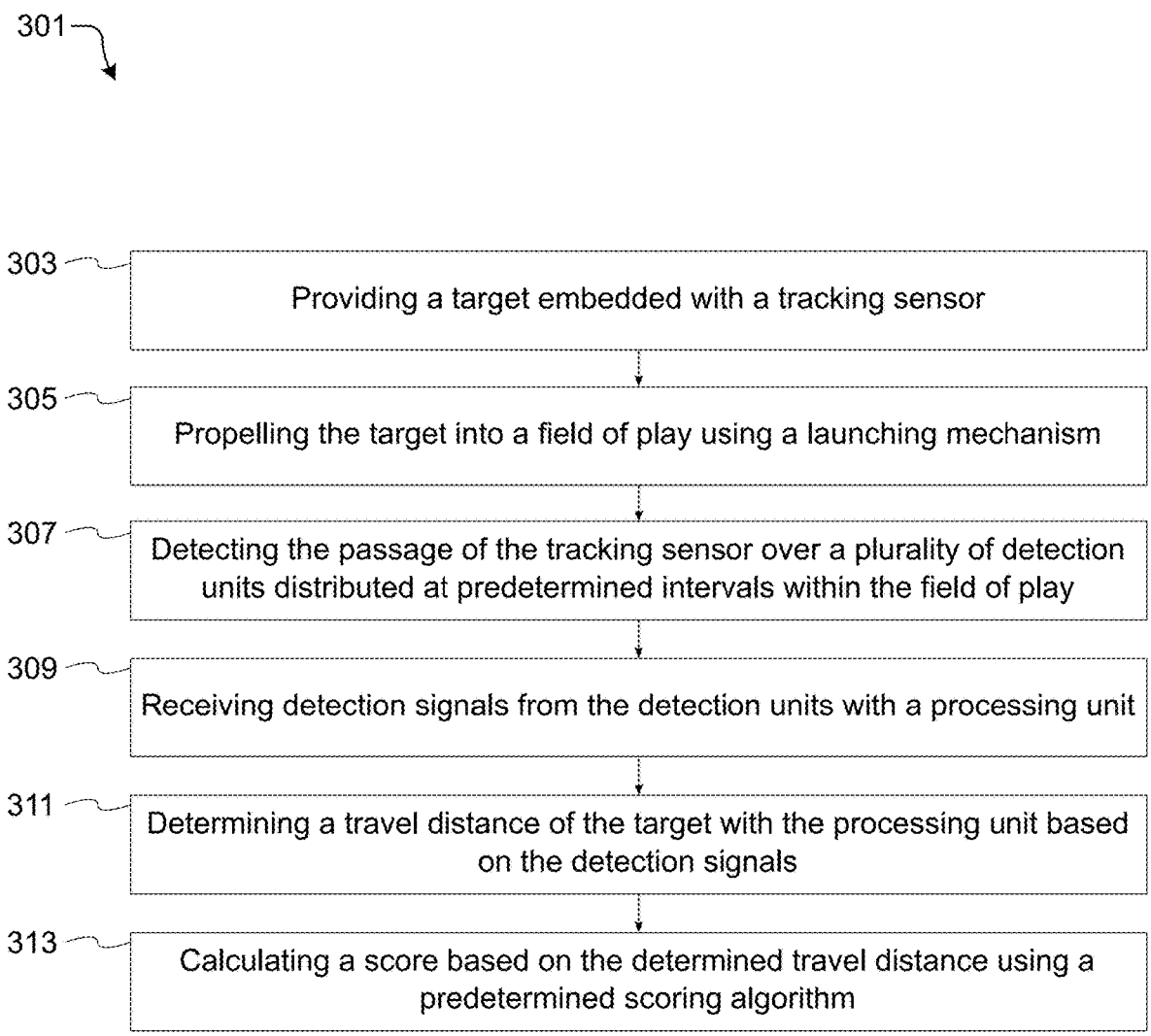
FIG. 3 is the methodology of use of the impact distance scoring system.

FIG. 3 depicts a method of use 301 for the system of FIGS. 1-2 in accordance with an embodiment of the present invention. The method 301 initiates with step 303 of providing a target embedded with a tracking sensor. The method 301 further includes a step 305 of propelling the target into a field of play using a launching mechanism. At step 307, the passage of the tracking sensor, and thereby the target, is detected over a plurality of detection units distributed at predetermined intervals within the field of play. A travel distance of the target is determined with the processing unit based on the received detection signals 309. A score is then calculated based on the determined travel distance using a predetermined scoring algorithm 311.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An impact distance scoring system for clay target shooting comprising:

a target embedded with a tracking sensor;

a launching mechanism configured to propel the target into a field of play;

a plurality of detection units distributed at predetermined intervals within the field of play, each detection unit configured to detect passage of the tracking sensor overhead; and a processing unit in communication with the plurality of detection units, the processing unit configured to receive detection signals from the detection units and to determine a travel distance of the target based on the detection signals;

wherein the tracking sensor is a radio frequency identification (RFID) tag, and wherein the detection units are RFID readers capable of detecting a signal emitted by the RFID tag.

2. The impact distance scoring system for clay target shooting of claim 1, further comprising a display device in communication with the processing unit, configured to display the determined travel distance.

3. The impact distance scoring system for clay target shooting of claim 1, wherein the processing unit calculates a score based on the determined travel distance and a predetermined scoring algorithm.

* * * * *